United States Patent [19]

Olivieri

[11] Patent Number: 4,547,980

[45] Date of Patent: Oct. 22, 1985

[54] SPROCKET DEVICE FOR THE FASTENING OF SKI-BOOTS

[75] Inventor: Oliviero Olivieri, Montebelluna, Italy

[73] Assignee: Icaro Olivieri & C.S.p.A., Montebelluna, Italy

[21] Appl. No.: 485,907

[22] Filed: Apr. 18, 1983

[30] Foreign Application Priority Data

Jun. 1, 1982 [IT] Italy ..... 22038/82[U]

[51] Int. Cl.[4] ..... A43C 11/00; A43B 11/00

[52] U.S. Cl. ..... 36/50; 24/70 SK; 24/71 SK; 24/269

[58] Field of Search ..... 36/50, 117; 24/68 SK, 24/69 SK, 70 SK, 71 SK, 269, 274 R, 607, 639

[56] References Cited

U.S. PATENT DOCUMENTS

| | | | |
|---|---|---|---|
| 2,993,680 | 7/1961 | Davis | 24/269 |
| 3,290,010 | 12/1966 | Holmes | 24/269 |
| 3,678,542 | 7/1972 | Prete, Jr. | 24/70 R |
| 4,326,320 | 4/1982 | Riedel | 24/70 SK |
| 4,395,801 | 8/1983 | Gabrielli | 24/70 SK |
| 4,433,457 | 2/1984 | Chalmers, II et al. | 24/71 SK |

FOREIGN PATENT DOCUMENTS

| | | | |
|---|---|---|---|
| 2806422 | 8/1978 | Fed. Rep. of Germany | 24/68 SK |

*Primary Examiner*—Werner H. Schroeder
*Assistant Examiner*—Steven N. Meyers
*Attorney, Agent, or Firm*—Birch, Stewart, Kolasch & Birch

[57] ABSTRACT

A device for fastening ski-boots, and which permits fine adjustment of the tightness of the fastening to be effected quickly and easily, includes a sprocket supported rotatably on a support plate and a tie with a rack portion engageable by the sprocket. The device also includes a ratchet mechanism for advancing the sprocket relative to the rack portion to tension the tie, and a ratchet mechanism for locking the sprocket so as to maintain the tension of the tie.

2 Claims, 5 Drawing Figures

FIG. 3
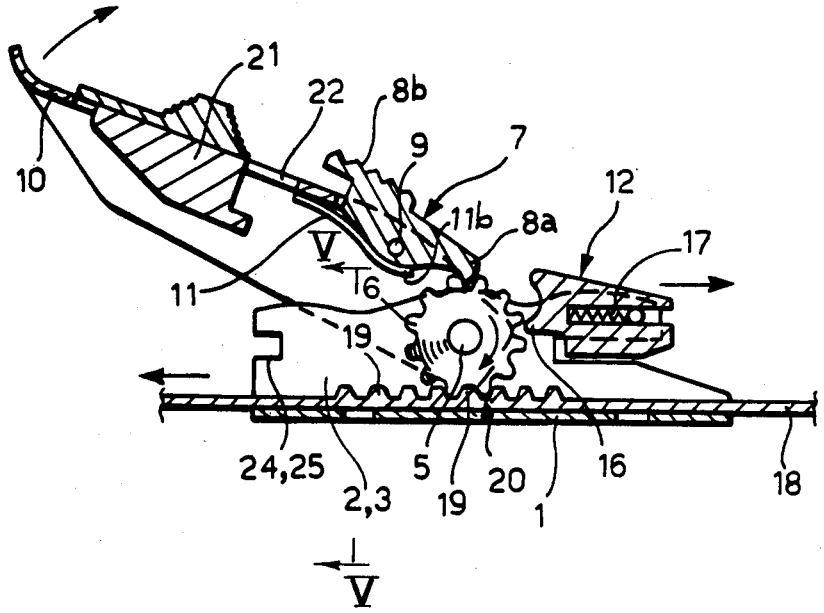
FIG. 4
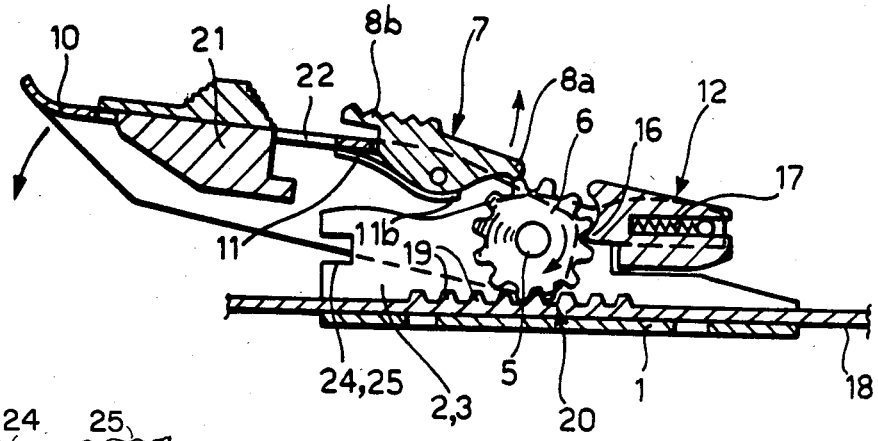
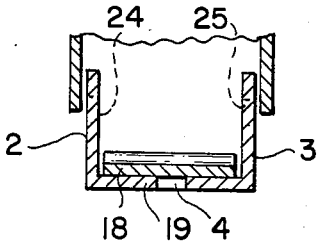
FIG. 5

SPROCKET DEVICE FOR THE FASTENING OF SKI-BOOTS

The present invention relates to a sprocket device for fastening ski-boots.

The main object of the invention is to provide a device of the aforesaid type which allows the tightness of the fastening to be varied and finely adjusted at will with operations that are easy and quick to carry out regardless of the environmental conditions in which they are affected.

Another object of the invention is to provide a device which ensures that the desired tightness of the fastening is maintained for an indefinite period, even during particularly violent and repeated sporting activities.

It is a further object of the present invention that the device should ensure that the ski-boot remains fastened even during violent, accidental collisions which occur frequently during sporting activities and which, as is well known, cause the opening of devices of the prior art.

According to the invention, these objects are achieved by a device for fastening ski-boots, which comprises: a support plate, a sprocket supported rotatably by the support plate, a tie having at least one rack portion engageable by the sprocket, a ratchet mechanism for advancing the sprocket relative to the rack portion to tension the tie, and a ratchet mechanism for locking the sprockets so as to maintain the tension of the tie.

To advantage, the tie is flexible, and in a preferred embodiment is constituted by a strap having at least one surface portion provided with a plurality of transverse teeth.

Prefereably, the ratchet mechanism for advancing the sprocket is operated manually by a lever pivoted on the support plate.

A preferred embodiment of the present invention will now be described, by way of example, with reference to the appended drawings, in which:

FIGS. 2 to 4 are longitudinal sectional views of the sprocket device of FIG. 1 in different successive positions of operation.

FIG. 5 is a vertical transverse sectional view taken on the line V—V of FIG. 3.

Figure 1:
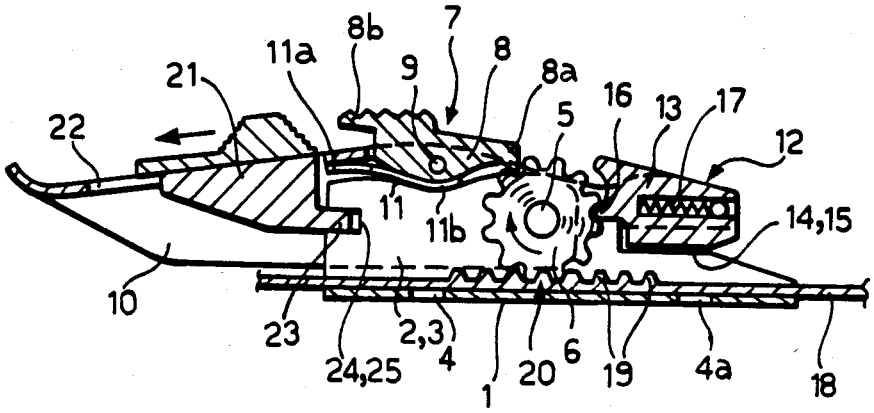
FIG. 1 is a longitudinal sectional view of a sprocket device according to the invention.

With reference to the drawings, a fastening device for ski-boots, according to the invention, comprises a support plate 1 provided with flanges 2, 3 along opposite sides, giving the support plate an essentially U-shaped cross-section. The support plate 1 has holes 4, 4*a* for engagement by conventional means, such as rivets, for fixing it to the upper of a ski-boot.

A pin 5 is supported transversely by the flanges 2, 3 of the support plate and a sprocket 6 is mounted rotatably on the pin 5. The outer radius of the sprocket 6 is less than the distance between the axis of the pin 5 and the base of the support plate 1, so that a gap of predetermined depth is defined between the sprocket 6 and the base.

A ratchet mechanism for advancing the sprocket 6 is generally indicated 7. In particular, the mechanism 7 includes a pawl 8 pivoted on a transverse pin 9 carried by a lever 10 which, in turn, is pivoted on the pin 5 on which the sprocket 6 is rotatable. A spring 11 has one end 11*a* fixed to the lever 10 and its other end 11*b* acting on the pawl 8 to maintain the active end 8*a* thereof in engagement with the teeth of the sprocket 6, as will become clear from the description below. The portion 8*b* of the pawl opposite its active end 8*a* is shaped as a grip for the disengagement of the active end 8*a* from the teeth of the sprocket 6 against the action of the spring 11.

A ratchet mechanism, generally indicated 12, for locking the sprocket 6 includes a body 13 which is slidably engaged in slots 14, 15 formed in the opposing flanges 2, 3 of the support plate 1 and extending longitudinally of the support. A projection 16 is formed on this body 13 and constitutes a pawl for releasably engaging the teeth of the sprocket 6. The body 13 is movable in the slots 14, 15 against the action of a spring 17.

The fastening device of this invention further includes a tie 18 which is preferably flexible and, more preferably, is constituted by a strap. This tie has at least one rack portion 20 constituted by a plurality of transverse teeth 19 which are releasably engageable with the teeth of the sprocket 6. The thickness of the strap 18 is substantially equal to the depth of the gap between the sprocket 6 and the base of the support plate 1.

The fastening device of this invention is also provided with releasable means for locking the device in its fastening position. In accordance with this preferred but non-exclusive embodiment, these means are constituted by a slider 21 which is movable in a guide slot 22 formed in the lever 10. On its surface facing the pawl 8, the slider 21 has a transverse tab 23 of predetermined thickness which is engageable with respective slots 24, 25 formed in the opposing flanges 2, 3 of the support plate 1.

The operation of the fastening device described above is as follows.

In an initial fastening condition, the lever 10 is held in the position closest to the base of the support plate 1 by the engagement of the tab 23 of the slider 21 in the slots 24, 25 of the opposing flanges 2, 3 of the support plate. The pawls 8*a*, 16, urged by their respective springs 11, 17, keep the sprocket 6 in engagement with the teeth 19 of the tie 18.

Figure 2:
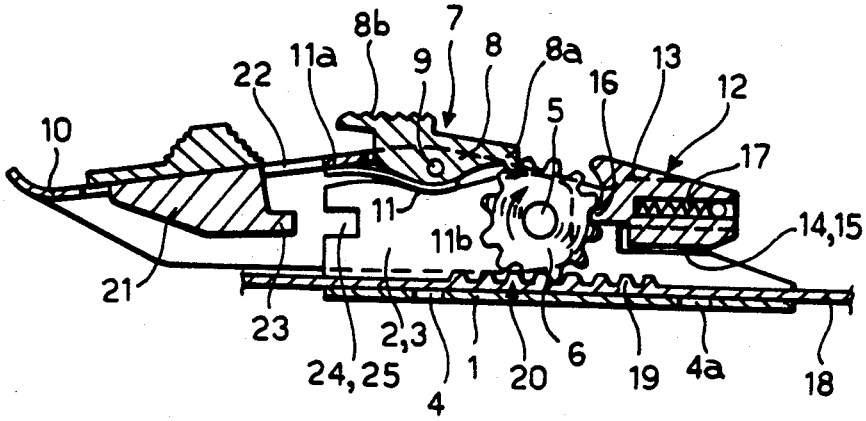

When it was wished to increase the tightness of the fastening described above, the following procedure is carried out. Initially, the slider 21 is withdrawn manually from the support plate 1 so as to disengage its tab 23 from the flanges 2, 3 of the support plate. The lever 10, thus freed, is now moved angularly in two senses, clockwise and counterclockwise, about the axis of the pin 5 (FIGS. 2 to 4), so as to operate the ratchet mechanism 7 for advancing the sprocket 6 relative to the teeth 19 of the tie 18. It should be noted that, when the mechanism 7 is "re-set", that is, brought back to its intital position, by angular displacement of the lever 10 about the pin 5 in the counterclockwise sense, the sprocket 6 is locked by the ratchet mechanism 12.

The rotational advancement of the sprocket 6, relative to the tie causes a translatory movement of the tie 18, and this advancement may be effected very rapidly and easily to obtain a fine adjustment of the tension of the tie and hence the tightness of the fastening of the ski-boot.

When the fastening has reached the desired tightness, the lever 10 is returned to the initial position and is locked by the displacement of the slider 21 into engagement with the support plate 1 (FIG. 1).

In order to unfasten the boot, that is, release the tie 18 from the sprocket 6, it suffices to depress the portion 8*b* of the pawl 8 so as to disengage its active end 8*a* from the sprocket 6 against the action of the spring 11, and withdraw the tie 18 from the support plate 1.

What is claimed is:

1. A device for fastening ski-boots and permitting a fine adjustment in the tightness of the fastening operation, wherein the device comprises:

a support plate provided with flanges along the opposite sides thereof, whereby the support plate has a substantially U-shaped cross-section;

a pin supported by said opposing flanges;

a sprocket rotatably mounted on the pin;

a tie constituted by a flexible strap having at least one portion thereof provided with a plurality of transverse teeth engageable by the sprocket;

a ratchet mechanism for advancing the sprocket relative to said teeth to tension the tie;

a lever for operating the ratchet mechanism, said lever being pivoted on said pin, a ratchet mechanism for locking the sprocket to maintain the tension of the tie;

a slot defined by said lever and a slider movable into and out of said slot;

respective slots formed in the flanges of the support plate, and a projecting tab formed on the slider for engagement with the slots of the flanges to lock the lever.

2. A device as defined in claim 1, wherein the ratchet mechanism for advancing the sprocket is operated by a lever pivoted to the support plate.

* * * * *